United States Patent [19]

Koch

[11] 4,090,800

[45] May 23, 1978

[54] JOINT-FORMING DEVICE

[76] Inventor: Vergil W. Koch, 1123 King St., Redwood City, Calif. 94002

[21] Appl. No.: 748,522

[22] Filed: Dec. 8, 1976

Related U.S. Application Data

[63] Continuation-in-part of Ser. No. 705,413, Jul. 15, 1976, abandoned.

[51] Int. Cl.[2] ..... E01C 11/04

[52] U.S. Cl. ..... 404/48

[58] Field of Search ..... 404/49, 48, 72, 47, 404/64, 65, 69, 87, 89; 52/396, 403

[56] References Cited

U.S. PATENT DOCUMENTS

| | | | |
|---|---|---|---|
| 1,089,943 | 3/1914 | Morse | 404/69 |
| 1,706,110 | 3/1929 | Fischer | 404/64 X |
| 3,136,022 | 6/1964 | Dohren | 404/64 X |
| 3,352,217 | 11/1967 | Peters | 404/65 |
| 3,434,401 | 3/1969 | Kiewit | 404/65 |
| 3,491,659 | 1/1970 | Crone | 404/89 X |
| 3,508,369 | 4/1970 | Tennison | 52/396 |
| 3,589,664 | 6/1971 | Middlestadt | 404/89 X |
| 3,593,626 | 7/1971 | Crone | 404/87 X |
| 3,838,930 | 10/1974 | Koch | 404/48 |
| 3,896,597 | 7/1975 | Deason | 404/64 X |
| 3,923,411 | 12/1975 | Berghman | 404/64 |
| 4,008,974 | 2/1977 | Miers | 404/48 |

*Primary Examiner*—Nile C. Byers

*Attorney, Agent, or Firm*—Owen, Wickersham & Erickson

[57] ABSTRACT

A device for forming surface joints in hardenable slab type structural materials such as freshly poured concrete is disclosed. The elongated joint former includes a pliable section having a depth which may be approximately one-fourth the thickness of the slab, with outwardly extending fins near its bottom and with a split upper end formed by a pair of separable walls. For implanting the pliable section in a fresh slab prior to its setting, a relatively rigid T-shaped implanting member is inserted into the split and the joint former is driven or vibrated down into the slab until the upper end of the pliable section is approximately even with or slightly below the surface of the slab. The T-shaped member is later removed, leaving an open-topped cavity in the joint into which particle fines eventually accumulate to continually push outwardly on the pliable member on either side of the split and thereby urge the sides of the pliable member against the slab and form an effective water seal during periods of slab expansion and contraction.

5 Claims, 4 Drawing Figures

JOINT-FORMING DEVICE

CROSS REFERENCE TO RELATED APPLICATION

This application is a continuation-in-part of application Ser. No. 705,413, filed July 15, 1976 now abandoned.

BACKGROUND OF THE INVENTION

The invention relates to the formation of expansion joints in a settable surface covering composition such as concrete as commonly used in the construction industry for sidewalks, airport runways and taxiways, roadways, building floors, decks, patios, etc. More particularly, it relates to a two-piece joint-forming device that can be implanted in a settable composition during the plastic stage, with one piece later removed to form a joint filled with a permanent, pliable joint material which effectively accommodates slab expansion and contraction. The invention also encompasses a method for forming a slab joint.

Such joints in most settable compositions such as concrete are necessary in order to prevent surface cracks due to expansion or contraction of the composition during curing and later on due to environmental temperature variations. In the prior art it has been known to use a joint former structure made of a plastic material formed as two portions connected by a severable web. Such a structure, as shown in U.S. Pat. No. 3,330,187, was inserted in freshly poured concrete mix and when the concrete had hardened an upper portion was severed from the lower portion buried in the concrete, thereby forming a surface groove. Although the aforesaid structure provided good results in many installations, as when used between masonry or terrazzo tiles, it was difficult to use with efficiency in the construction of large concrete slabs, such as roadways, aircraft runaways and the like. The problem arose because this prior joint forming structure was too flexible and would bend or flex when forced vertically into freshly poured concrete. Thus, it became very difficult to maintain adequate straightness for the joint grooves without the use of additional equipment, time and labor. Also, in the aforesaid joint structure the top portion once severed from the bottom portion became a waste product and was not reuseable. This not only increased its relative cost but also created a waste disposal problem.

In my U.S. Pat. No. 3,838,930 is disclosed two-piece joint forming structure in which a top portion is removable from the bottom portion and reuseable. The pliable bottom portion remains below the surface of the slab, with a permanent groove in the slab positioned thereabove.

U.S. Pat. No. 3,923,411 discloses a generally V-shaped sealing strip for use in sealing a pre-existing joint between concrete slabs. The device does not form joints in freshly poured compositions, and the two sides of the "V" are firmly locked and sealed together near the top following installation of the device.

While several of the devices discussed above are effective in causing shrinkage cracking and thermal cracking to occur at the joint, and are relatively efficient in preventing the intrusion of water downwardly through the joint, none provides as effective a water seal in an integrally formed joint, especially during expanded and contracted periods, as does the joint-forming device of the invention as described below.

SUMMARY OF THE INVENTION

The present invention provides, in several embodiments, an elongated strip-like joint forming device for freshly poured slabs, and a joint forming method employing the device. A pliable main section having a split upper end is forced downwardly into the fresh unset poured material with a T-shaped, temporary implanting member inserted in the split for receiving the downward force. The pliable main member is implanted with its upper end generally flush with the slab surface or slightly below the slab surface, and fins near the lower end of the member extend outwardly in both directions into the poured material to provide multiple water seals. A series of horizontal holes which may be provided through the length of the member help provide for absorption of the expansion and contraction of the slab. The T-shaped member is removed after implanting of the main member, or later, after setting of the slab, leaving an open-topped cavity in the split at the top of the pliable main member. Eventually, this cavity fills with fine particles of sand and grit, which continually push outwardly on the walls about the split, against the slab at both sides of the joint. This provides additional and highly effective water sealing at the top of the joint, by continually exerting a spreading force at the top of the pliable member to tightly seal it against the slab regardless of thermal expansion and contraction.

The T-shaped implanting member may be reused for implanting additional pliable joint-formers at other locations or in other slabs. Also, it may include small barb-like projections in its vertical stem to help hold it in the split upper end of the main section during installation in a slab. Alternatively, or in addition, the T-shaped member may include a pair of vertically depending clips extending downward from its top flange to engage the outsides of the pliable member's upper end for greater stability and easier alignment during implanting.

It is therefore among the objects of the invention to provide an improved joint-former for poured but unset slabs, wherein thermal expansion and contraction of the slab are accommodated substantially without loss of water sealing capability and without extrusion of the pliable joint sealer out the top of the joint during periods of slab expansion.

Other objects, advantages and features of the invention will become apparent from the following detailed description of several embodiments, presented in conjunction with the accompanying drawings.

DESCRIPTION OF THE PREFERRED EMBODIMENTS

Figure 1:
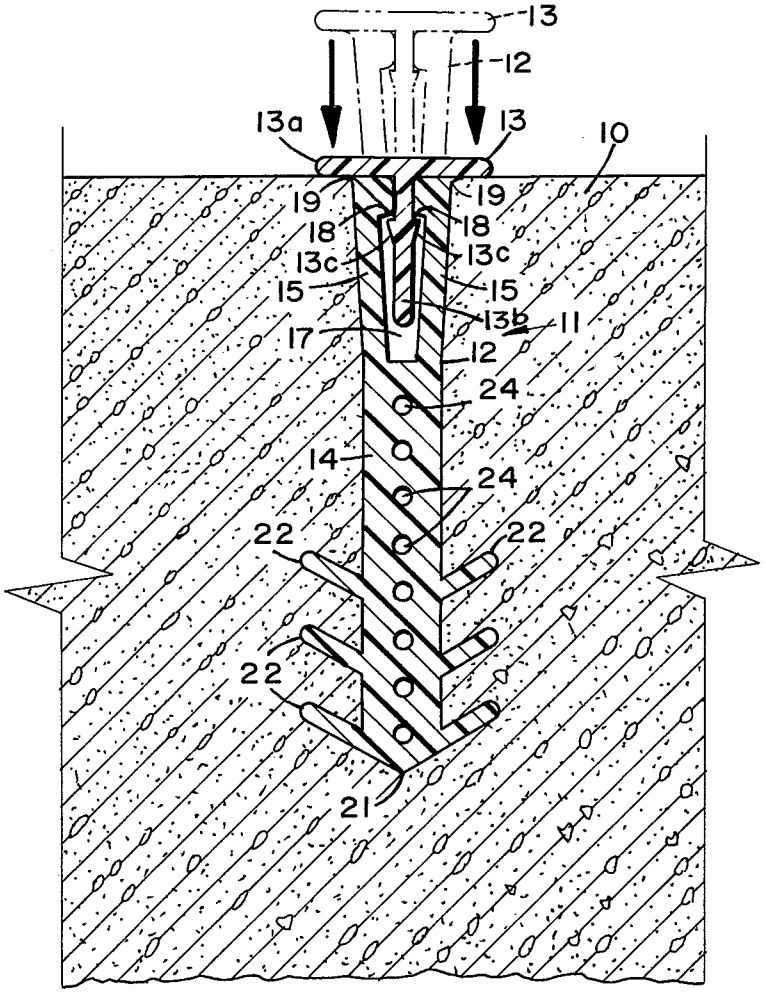
FIG. 1 is a sectional view in elevation showing a poured slab into which a joint-forming device according to the invention has been implanted.

In the drawings, FIG. 1 shows a slab 10 of a poured, settable composition, prior to setting. Into the slab has been forced one embodiment of a joint-forming device 11 according to the invention, including a pliable main section 12 and a relatively rigid, removable T-shaped implanting member 13 inserted into the top of the main member 12. Only the cross sections of the members 12 and 13 are shown in the drawings; their cross sections are continuous throughout their length, and their length is co-extensive with the length of the joint which is formed across the slab 10. To implant the device 11, the flat upper flange 13*a* of the T-shaped member is engaged by a hand tool or a larger powered apparatus (not shown) which forces the member downwardly into the unset slab 10. The operation of the implanting apparatus may include driving impact or vibration or both, such apparatus being well known in the joint forming art. The relatively wide, flat upper surface 13*a* of the T-shaped member 13 can be effectively engaged by the implanting apparatus to maintain a straight vertical alignment of the joint forming device 11 as it is pushed into the slab.

For effective sealing properties the pliable main member 12 should be formed from a relatively resilient, durable material such as plasticized polyvinylchloride (PVC), rubber or neoprene. Plasticized PVC having a specific gravity of around 1.3 and a Shore A hardness of around 70 to 85 is a very suitable material. The T-shaped member 13 is preferably made from a relatively rigid material such as rigid PVC, steel or aluminum.

The pliable main member 12 has a generally rectangular body section 14 and a split upper end formed by a pair of vertical walls 15. The stem 13*b* of the T-shaped member 13 is inserted between these walls when the device 11 is to be installed, with the lower surfaces of the top flange 13*a* positioned against the tops of the vertical walls 15, as shown. The walls 15 may simply be formed by splitting the otherwise generally straight upper end of the pliable member 12, with the T-member stem 13*b* wedged between them, but the configuration is preferably as shown, with a central cavity 17 between them even when the T-member is absent. Accordingly, each wall 15 preferably includes on its inner side a bead 18 which, when the T-shaped member is inserted therein, establishes a desired spacing between the walls 15 and a desired size for the cavity 17, substantially avoiding interference between the T-member stem 13*b* and the walls 15 except at the upper positioned beads 18. As shown in FIG. 1, when the joint forming device 11 of this embodiment is first fully implanted in the slab 10, the overlapping edges of the T-member flange 13*a* preferably rest against and approximately flush with the surface of the slab 10. The two members may be pushed lower than this if desired, as in the other embodiment described below, but they should be inserted at least to this depth. The body section 14 of the member 12 should be of sufficient thickness to be strong enough to avoid buckling during implanting.

As illustrated in FIG. 1, the T-member 13 of this embodiment may include on its stem 13*b* a small barb-like member 13*c* on each side. The members 13*c*, which help hold the T-member in place during installation of the device 11 by engaging the undersides of the beads 18, may be continuous or may occur at spaced intervals along the length of the T-member. To facilitate easy removal of the T-member 13 when the device 11 is implanted in a slab, the barb-like members 13*c* should extend only a small distance from the stem 13*b*. The main section 12 of the joint former, including the beads 18, is sufficiently pliable that the T-member stem 13*b* can be removed from the installed main section without appreciable spreading of the vertical walls 15.

At the outer and upper edge of each wall 15 of this embodiment of the joint former is preferably included an ouwardly projecting lip 19, tapering or curving into the wall's outer surface. This causes the slab, at either side of the joint, to form into a rounded or beveled edge as illustrated, so that sharp, frangible slab edges are avoided.

The lower tip 21 of the pliable main member 12 is preferably rounded or arrowhead shaped as shown, so that penetration into the slab and maintenance of the vertical orientation are aided. This tip 21 may coincide with the apex of the lowermost pair of a series of pairs of outwardly extending fins 22. Each fin 22 is preferably upwardly inclined as shown, and with a substantial width which may be approximately equal to the thickness of the main member 12. The width of these fins 22 helps lock the member 12 in the unset slab material, and when the material (such as concrete) later shrinks and pulls apart at the joint as will be discussed below, the fins remain seated in the slab material and still provide an effective water seal through this contact. The upward fin inclination helps retain the member 12 in the joint when extreme slab expansion (joint closure) would tend to extrude the member 12 upwardly. The number of pairs of fins provided depends upon the depth of the joint forming device 11. For a joint former depth in the neighborhood of about 2 inches, preferably three pairs of fins 22 are provided, as shown. An additional pair of fins may be provided for each additional ½ inch depth of the device. Similarly, a one and one-half inch joint former might have only two pairs of fins. In general, the depth of the device 11 is preferably at least about one-fourth the depth of the slab in which it is implanted. Thus, the device shown in the figures would be appropriate for a slab of up to about 8-inch thickness.

In addition to the central cavity 17 near the top of the pliable main member 12 of the joint former a series of openings 24 should also be provided to increase compressibility of the member 12 below the upper cavity 17. These openings 24 may take the form of a spaced succession of longitudinal bores extending through the length of the member 12 as shown. Thus, in addition to the inherent resilience of the pliable main member 12, the internal openings 17 and 24 provide for absorption of expansion and contraction movement of the slab 10 about the joint. In particular, this (in conjunction with the inclination of the fins 22) helps prevent the upward extrusion of the member 12 out of the joint during periods of thermal expansion of the slab, which has been a problem with many sealing compounds heretofore used in concrete slab joints.

Figure 2:
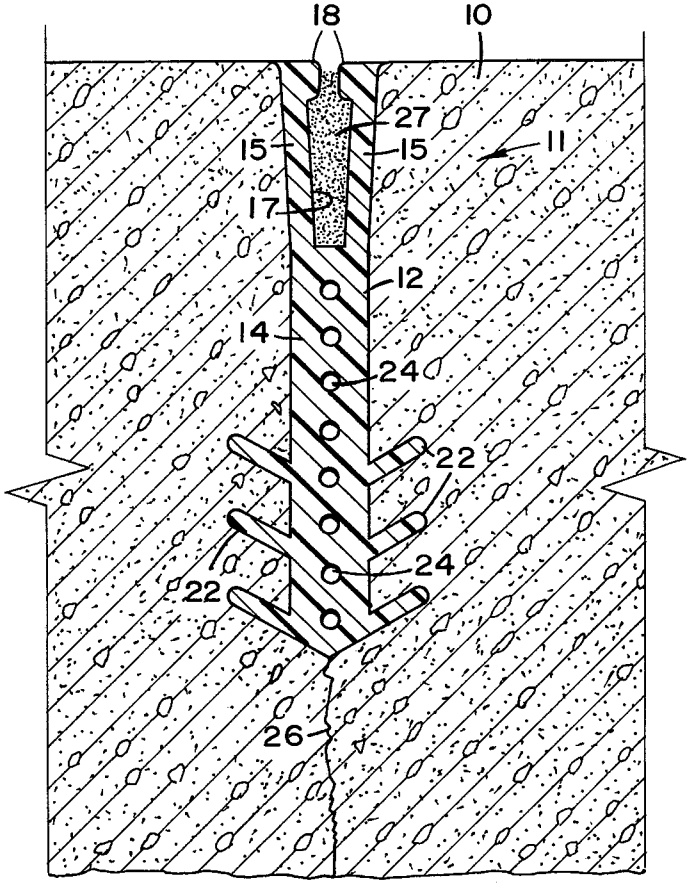
FIG. 2 is a similar view of the slab and joint-forming device after a temporary upper component has been removed, the slab has cracked at the desired location, and an open-topped cavity at the top of the joint former has filled with particle fines.

FIG. 2 shows the slab 10 and joint forming device 11 after the poured slab material has set and a period of time has elapsed. The T-shaped implanting member 13 has been removed, and the top of the pliable member 12 is approximately flush with the surface of the slab 10, although it may be somewhat lower than flush as discussed above. The T-shaped member may be removed at any time after implanting of the joint forming device 11, but the slab is preferably allowed to first set to some extent, since the plastic unset composition could flow to some degree, thereby moving the upper walls 15 more closely together, perhaps even closing the gap between the two beads 18.

As indicated, a crack 26 has formed in the slab below the joint-forming device. This crack may occur during shrinkage while the slab 10 sets, or from later thermal contraction. By forming a separation in the upper portion of the slab (approximately one fourth the depth, as discussed above) the joint-former 11 thus concentrates the inevitable cracking to the location of the joint, in the well known manner.

As also shown in FIG. 2, the upper cavity 17 between the walls 15 of the member 12 has filled with particle fines 27. These fines may originate primarily from a finishing process used on the surface of many slab-type constructions. Before the slab material has fully set and hardened, fines of sand or other particulate material are spread over and worked into the surface. As these fines are spread, they fall between the beads 18 of the walls 15 to fill or substantially fill the cavity 17. Alternatively, or in addition to the finishing type fines, the fines 27 falling into the cavity may comprise accumulated fine grit or sand material falling into the cavity from later traffic over the slab.

As discussed above, the fines 27 accumulated in the joint former cavity 17 act in a highly efficient manner to seal the walls 15 tightly against the edges of the slab at the joint, thereby effectively preventing the intrusion of water down into the joint along the sides of the joint former member 12. The continuous accumulating and settling action of the fines 27 exerts a continuous spreading force on the walls 15 to hold them outwardly against the slab, even during periods of slab contraction when the joint widens. When the joint is narrowed during periods of thermal expansion, the walls 15 are forced inwardly and although the particle fines 27 resist this movement, they will yield and squeeze upwardly to some extent.

The sealing action of the fines 27 and walls 15 is in addition to and in conjunction with the efficient sealing provided by the pairs of fins 22 below. Although the use of outwardly projecting fins in a joint-former is known (see, for example, my U.S. Pat. No. 3,838,930), the fins 22 of the present joint former construction are much longer (in cross section) than fins generally used in such devices previously. The fins 22 extend outwardly a distance which may be approximately equal to the thickness of the main member 12, at an upward angle as discussed above. This increased fin length helps to provide a better water seal by increasing the sealing contact area with the slab and by maintaining a large contact area even during periods of extreme slab contraction. As the slab contracts and separates at the joint, the fins 22 remain in contact with the slab even when it separates to the extent that it pulls away from the main body of the main member 12. This in conjunction with the action of the fines 27 on the walls 15 above provides a highly effective, year-around seal against the intrusion of water flowing downwardly in the joint. Such sealing action has been unknown in previous joint forming devices of such simplicity, particularly those requiring no composition type sealant material. It should be emphasized that absolutely no sealant need be used with the joint forming device 11, either above the device or along its sides, due to the action of the expandable vertical walls 15 and the action of these walls in combination with that of the fins 22 below. An effective seal is highly important at a slab joint as is well known in the industry, since water seeping below the slab can undermine the slab, and water either in or below the joint can freeze to cause heaving and deterioration of the slab.

The pliable, resilient main member 12 of the joint forming device is also highly durable and longlasting in service. The preferred material for this member is plasticized polyvinylchloride which retains its resilient properties over periods of many years in such service.

Figure 3:
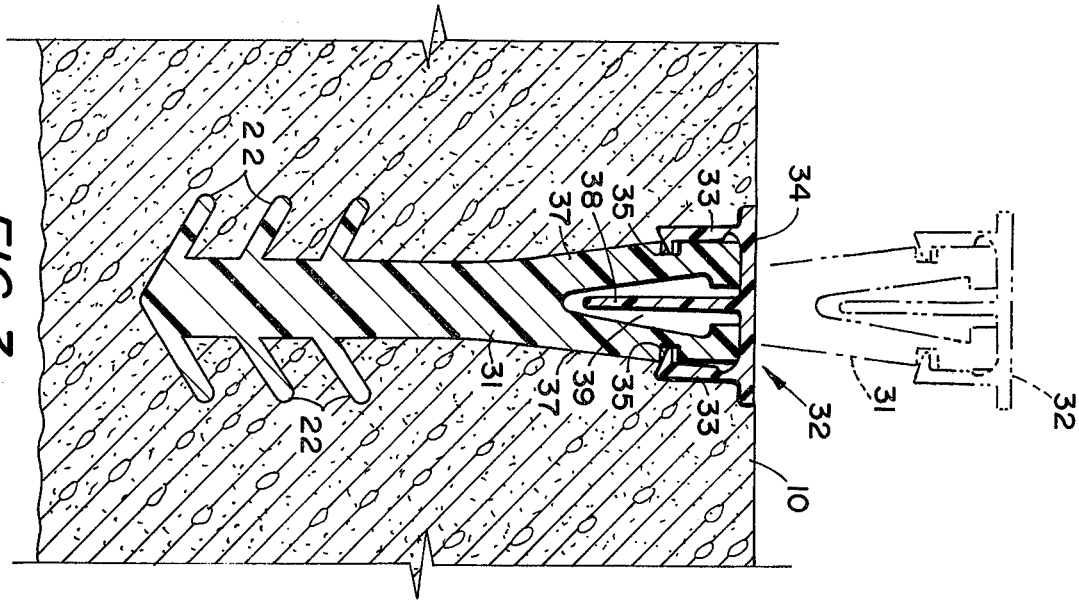
FIG. 3 is a view similar to FIG. 1 but showing another embodiment of the invention; and FI. 4 is a view similar to FIG. 2, but showing the joint former of FIG. 3.
Figure 4:
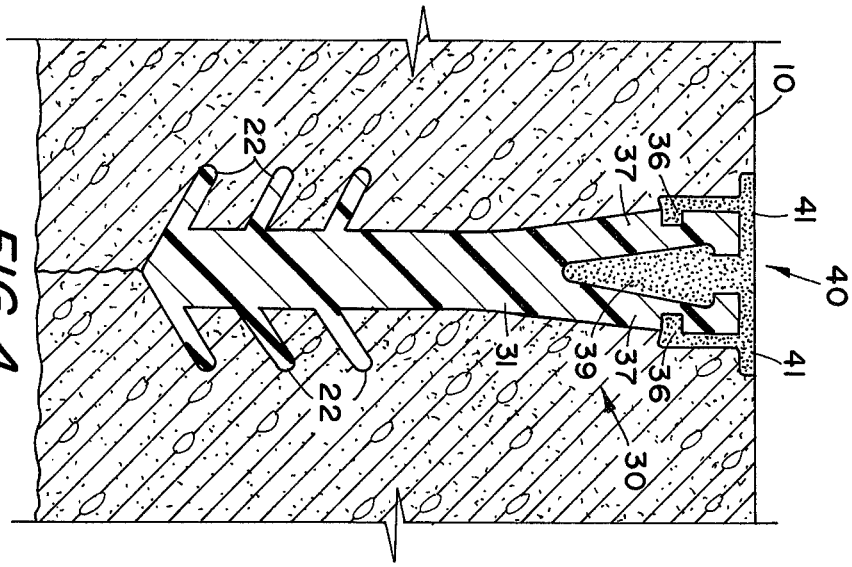

Shown in FIGS. 3 and 4 is another embodiment of a joint forming device according to the invention, generally identified by the reference number 30. The joint former 30 is similar in structure and identical in operation to the above described joint former 11, and includes a pliable main body member 31 and a removable T-shaped implanting member 32. However, for increased stability and ease of alignment in the implanting operation, which are needed in many installations, the T-shaped member 32 grips the main member 31 in a different manner in this embodiment. A pair of continuous vertically depending clips 33 extend from the top flange 34 of the T-shaped member 32 as shown, and include barb-like ends 35 for engaging correspondingly positioned recesses 36 (see FIG. 4) in the sides of the main member 31.

As in the above described joint forming device 11, the main body member 31 has a split upper end formed by a pair of generally vertical walls 37. The side clips 33 of the T-member 32, with their barbed ends 35, are spaced apart such that the barbs springingly engage the recesses 36 when the T-member is pressed onto the main member 31. A stem 38 of the T-member extends between the walls 37 and into a central cavity 39, as in the previously described embodiment.

The joint former assembly 30 shown in FIG. 3 is an integral unit, tightly retained together, when being implanted into a slab 10 by an impact or vibrating device as discussed above. It is generally more easily maintained in alignment during implanting, and thus more easily installed, than the above described joint former 11. Thus, its use is preferred in many installations.

As indicated in FIGS. 3 and 4, the joint forming device 30 is preferably implanted into the slab 10 to a depth wherein the top of the T-shaped implanting member 32 is approximately flush with the surface of the slab. This may be done with the earlier described joint former 11 also, but it is more important with the present embodiment, since the side clips 33 are present on the T-member 32, creating space between the slab and either side of the pliable main member 31 near its top once the T-member is removed, as shown in FIG. 4. If the pliable main member 31 were implanted with its top flush with the slab, the spacing on either side of its top would enable it to be kicked and otherwise moved back and forth, at least initially. This movement could cause undue wear on both the member 31 and on the slab. Thus, it is better that the member 31 be recessed slightly below the slab surface, as shown in FIG. 4. This is easily accomplished with this type joint former, since as shown in FIG. 3, the side clips 33 act as tapering ledges so that very little underside surface area of the top flange 34 abuts against the slab for the final fractional inch of implanting.

The T-shaped member 32 is easily removed after the slab 10 has partially or completely set up. The main member 31 is pliable and its walls 37 can easily bow inward to release the barb-like ends 35 of the T-member clips 33. This leaves a joint cavity 40 shaped generally as shown in FIG. 4, to be filled with particle fines or grit 41 just as described above. When the central cavity 39 has filled with such fines, outward pressure is exerted against the slab by the lower portions of the walls 37 to provide an effective water seal in the same manner as described above. Fins 22 below provide additional sealing in cooperation with the seal formed by the walls 37, as also described above. This embodiment of the joint former is shown without longitudinal holes in the pliable main member 31, unlike the member 12 discussed previously, but the holes may be provided for further expansion absorption if desirable for the particular installation. Since the member 31 is implanted slightly below the slab surface, however, extrusion of of the member outwardly from the joint is more easily avoided. Thus, from this standpoint the necessity for such holes is lessened.

The above described preferred embodiments provide joint forming apparatus and method which facilitate a fast and simplified procedure for formation of a joint in a poured slab-type composition, with a tightly and continuously water-sealed joint resulting. Various other embodiments and alterations to these preferred embodiments will be apparent to those skilled in the art and may be made without departing from the spirit and scope of the following claims.

I claim:

1. An elongated joint-forming structure for use with settable compositions used for slab-like installations, comprising:

a vertically elongated, pliable main section of flexible material, with fins extending outwardly from opposite sides of its lower end, and a split upper end extending down through a portion of the depth of the main section, formed by a pair of vertical walls connected at their lower ends and having generally planar, horizontal upper surfaces establishing a bearing surface for a downwardly applied load, each vertical wall having on its inner side, near its upper surface, a spacing lip holding the walls spaced apart to form a cavity in the upper part of the main section between the walls below the lips;

a T-shaped implanting member for use in implanting the main section in an unset slab, and for subsequent removal, said T-shaped member being relatively rigid with respect to the pliable main section and having a vertical stem for insertion between the vertical walls, the stem being of a depth less than that of the lower end connection of the two vertical walls so that it does not reach the bottom of the cavity, and a top flange on the T-shaped member for bearing downwardly against the generally planar upper surfaces of the vertical walls and transmitting an implanting force evenly to the main section, said top flange adding horizontal rigidity when the two components are assembled so that the joint-forming structure is kept in straight alignment during implanting in a slab, and said stem in said cavity adding vertical stability to avoid tipping and buckling of the relatively flexible, pliable main section during implanting.

2. An elongated joint-forming structure for use with settable compositions used for slab-like installations, comprising:

a vertically elongated, pliable main section of flexible material, with fins extending outwardly from opposite sides of its lower end, and a split upper end formed by a pair of vertical walls connected at their lower ends and having generally planar, horizontal upper surfaces establishing a bearing surface for a downwardly applied load, each vertical wall having on its inner side, near its upper surface, a spacing lip holding the walls spaced apart to form a cavity between the walls below the lips;

a relatively rigid, T-shaped implanting member for use in implanting the main section in an unset slab, and for subsequent removal, said T-shaped member having a vertical stem for insertion between the vertical walls, the stem being of a depth less than that of the lower end connection of the two vertical walls so that it does not reach the bottom of the cavity, and a top flange on the T-shaped member for bearing downwardly against the generally planar upper surfaces of the vertical walls and transmitting an implanting force evenly to the main section, said top flange adding horizontal rigidity when the two components are assembled so that the joint-forming structure is kept in straight alignment during implanting in a slab, and said stem in said cavitiy adding vertical stability to avoid tipping and buckling of the relatively flexible, pliable main section during implanting, said T-shaped implanting member further including a pair of clip means extending generally vertically downwardly in spaced parallel relationship to one another from the top flange, for engaging the outsides of the vertical walls of the main section, to add stability to the joint-forming structure during implanting.

3. The joint-forming structure of claim 2 wherein said clip means each include a barb-like end extending inwardly toward the main section, and the main section includes a corresponding notch positioned in its outside surface on each side for engagement by the corresponding barb-like end.

4. An elongated joint-forming structure for use with settable compositions used for slab-like installations, comprising:

a vertically elongated, pliable main section of relatively flexible material, with a plurality of water-sealing fins extending outwardly from opposite sides of its lower end, and a split upper end extending downwardly through a portion of the depth of the main section, formed by a pair of spreadable vertical walls connected at their lower ends and having upper surfaces establishing a bearing surface for a downwardly applied load, each of said vertical walls including a spacing lip on its inner side near its upper end, holding the walls spaced apart and forming a permanent cavity in the upper part of the main section between the walls below the lips;

a T-shaped implanting member of relatively rigid material in comparison with the pliable main section, having a vertical stem extending between said vertical walls and a top flange having lower surfaces positioned against said bearing surface and an upper surface adapted to be engaged by an implanting implement;

whereby the main section and the attached implanting member may be driven downwardly into a slab prior to setting until said bearing surface of the main section is at least flush with the slab surface, said top flange adding horizontal aligning rigidity and said stem in said cavity adding vertical stability to the pliable main section during implanting, and whereby the implanting member may be later removed.

5. An elongated joint-forming structure for use with settable compositions used for slab-like installations, comprising:

a vertically elongated, pliable main section of relatively flexible material, with a plurality of water-sealing fins extending outwardly from opposite sides of its lower end, and a split upper end formed by a pair of spreadable vertical walls connected at their lower ends and having upper surfaces establishing a bearing surface for a downwardly applied load, each of said vertical walls including a spacing lip on its inner side near its upper end, holding the walls spaced apart and forming a permanent cavity between the walls below the lips;

a T-shaped implanting member of relatively rigid material, having a vertical stem extending between said vertical walls and a top flange having lower surfaces positioned against said bearing surface and an upper surface adapted to be engaged by an implanting implement, said T-shaped implanting member including a pair of clip means extending generally vertically downwardly in spaced parallel relationship to one another from the top flange, for engaging the outsides of the vertical walls of the main section, to add further stability to the joint-forming structure during implanting;

whereby the main section and the attached implanting member may be driven downwardly into a slab prior to setting until said bearing surface of the main section is at least flush with the slab surface, said top flange adding horizontal aligning rigidity and said stem in said cavity, along with said clip means, adding vertical stability to the pliable main section during implanting, and whereby the implanting member may be later removed.

* * * * *